US006732716B2

(12) United States Patent
Bootle et al.

(10) Patent No.: US 6,732,716 B2
(45) Date of Patent: May 11, 2004

(54) METERING VALVE ARRANGEMENT

(75) Inventors: Geoffrey D Bootle, Maidstone (GB); William R Burborough, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 56 days.

(21) Appl. No.: 10/264,526

(22) Filed: Oct. 3, 2002

(65) Prior Publication Data

US 2003/0226547 A1 Dec. 11, 2003

(30) Foreign Application Priority Data

Oct. 3, 2001 (GB) ..... 0123773

(51) Int. Cl.[7] ..... F02M 39/00

(52) U.S. Cl. ..... 123/502; 417/218

(58) Field of Search ..... 123/500, 501, 123/502, 179.17, 364

(56) References Cited

U.S. PATENT DOCUMENTS

| | | | | | |
|---|---|---|---|---|---|
| 4,508,489 | A | * | 4/1985 | Howes | 417/221 |
| 5,123,393 | A | * | 6/1992 | Djordjevic | 123/502 |
| 5,180,290 | A | * | 1/1993 | Green | 417/218 |
| 5,524,822 | A | | 6/1996 | Simmons | |
| 5,769,056 | A | * | 6/1998 | Geiger et al. | 123/502 |
| 6,041,759 | A | * | 3/2000 | Burborough | 123/501 |
| 6,363,917 | B1 | * | 4/2002 | Hopley | 123/502 |
| 6,401,695 | B1 | | 6/2002 | Cooke | |
| 6,435,168 | B1 | | 8/2002 | Bircann et al. | |
| 6,497,225 | B1 | | 12/2002 | Bircann et al. | |

OTHER PUBLICATIONS

European Patent Application No. EP 1067321A2; Fluid Metering Valve; Filed Jun. 28, 2000.

* cited by examiner

*Primary Examiner*—Thomas N. Moulis
(74) *Attorney, Agent, or Firm*—David P. Wood

(57) ABSTRACT

A metering valve arrangement comprises a metering valve member which is angularly adjustable within a metering valve bore provided in a metering valve housing and an adjustment arrangement for adjusting the axial position of the metering valve member within the metering valve bore. The metering valve arrangement includes a first opening provided in the metering valve member which is registerable with a first outlet provided in the metering valve housing to control a first rate of flow of fluid through the first outlet depending on the angular position of the metering valve member within the bore, and a second opening provided in the metering valve member which is registerable with a second outlet provided in the metering valve housing to control a second rate of flow of fluid through the second outlet. The first and second outlets and the first and second openings are shaped and configured to ensure the first rate of flow of fluid maintains a substantially constant relationship to the second rate of flow of fluid for any axial position of the metering valve member within the metering valve bore. The metering valve arrangement is particularly suitable for use in an advance arrangement for adjusting the timing of fuel delivery by a pump, in which the first outlet of the metering valve arrangement communicates with a low pressure drain and a first rate of flow of fuel through the first outlet determines fuel pressure within a light load control chamber of the advance arrangement, and wherein the second outlet of the metering valve arrangement communicates with the pump and a second rate of flow of fuel through the second outlet determines the pressure of fuel delivered to the pump.

15 Claims, 4 Drawing Sheets

METERING VALVE ARRANGEMENT

FIELD OF THE INVENTION

The invention relates to a metering valve arrangement of the type suitable for use in an advance arrangement for controlling the timing of fuel delivery by a high pressure fuel pump of a compression ignition engine. In particular, the invention relates to a metering valve arrangement for use in an advance arrangement having a light load advance scheme to permit the timing of fuel delivery by the pump to be varied depending on the load under which the engine operates.

BACKGROUND OF THE INVENTION

In a diesel engine of an alternator or generator set it is necessary to vary the fuelling level to the engine in response to changes in engine load so as to ensure engine operation is maintained at a substantially constant speed. Typically, a metering valve is arranged to control the supply of fuel from a transfer pump to a high pressure rotary fuel pump which delivers fuel at high pressure to the engine. The rotary fuel pump includes a cam ring which is angularly adjustable with respect to a pump housing. The cam ring includes a plurality of cam lobes and encircles part of a distributor member which includes pumping plungers which are slidable within respective bores of the distributor member to cause pressurisation of fuel within an associated pumping chamber. The pumping plungers have associated respective shoe and roller arrangements, the rollers of which are engagable with the cam surface of the cam ring.

The output pressure of the transfer pump (referred to as "transfer pressure") is controlled so as to be related to the speed of operation of the engine with which the pump is being used. Rotation of the distributor member relative to the cam ring causes the rollers to move relative to the cam ring, engagement between the rollers and the cam lobes thereby causing the plungers to be forced in a radially inward direction to pressurise fuel within the respective bore and causing fuel to be delivered by the pump at relatively high pressure. By altering the angular position of the cam ring by means of an advance arrangement, the timing at which fuel is delivered by the pump can be adjusted.

A servo-advance scheme is provided to adjust the timing of fuel delivery by the pump in response to changes in engine speed. A light load advance arrangement may also be provided, including a light load sensing piston which is movable relative to the advance piston against the action of a light load control spring. A force due to fuel pressure within a light load control chamber acts on the light load piston, in combination with the light load control spring, to determine the relative axial positions of the light load piston and the advance piston and, hence, the maximum permitted degree of advance. The light load advance scheme also adjusts the characteristics of the servo-advance.

The metering valve controlling the level of fuelling to the high pressure pump is also operable to control the pressure of fuel within the light load control chamber (signal pressure) depending on the load under which the engine is operating. The metering valve is configured such that, depending on the engine load, the pressure of fuel acting on the light load piston varies and the position of the light load piston changes. The metering valve includes a metering valve member provided with a first port which cooperates, in use, with a first outlet port through which fuel flows to low pressure (e.g. the cam box) to vary the pressure of fuel within the light load control chamber. The metering valve member is angularly adjustable within a metering valve bore provided in a housing within which the first outlet port is defined, the rate of flow of fuel to low pressure, and hence the pressure of fuel within the light load control chamber, being varied by adjusting the angular position of the metering valve member within the bore.

The metering valve is also provided with a second port which cooperates with a second outlet port in the housing to regulate the level of fuelling, and hence the pressure of fuel (filling pressure), delivered to the pumping chambers of the high pressure pump. The first and second ports in the metering valve member are positioned such that the desired relationship between signal pressure and filling pressure is achieved at a given engine speed.

Due to variations in governor components during manufacture and due to different engine and alternator requirements upon installation and wear of such components in use, the provision of a droop control arrangement is desirable in alternator sets. Droop control permits control over the change in engine speed which must occur in order for the metering valve member to move between its fully open and fully closed positions. In single speed alternator and generator sets, it is known to provide a droop adjustment arrangement which permits the axial position of the metering valve member within the metering valve bore to be varied so as to alter the relationship between the angular position of the metering valve member and the fuel flow rate through the metering valve.

The provision of a light load advance scheme in an alternator set for single speed applications is considered to be an essential requirement for emissions purposes. It is an object of the present invention to enable this to be achieved.

SUMMARY OF THE INVENTION AND ADVANTAGES

According According to a first aspect of the present invention there is provided a metering valve arrangement comprising;

- a metering valve member which is angularly adjustable within a metering valve bore provided in a metering valve housing,
- an adjustment arrangement for adjusting the axial position of the metering valve member within the metering valve bore,
- a first opening provided in the metering valve member which is registerable with a first outlet provided in the metering valve housing to control a first rate of flow of fluid through the first outlet depending on the angular position of the metering valve member within the bore, and
- a second opening provided in the metering valve member which is registerable with a second outlet provided in the metering valve housing to control a second rate of flow of fluid through the second outlet, wherein the first and second outlets and the first and second openings are shaped and configured to ensure the first rate of flow of fluid maintains a substantially constant relationship to the second rate of flow of fluid for any axial position of the metering valve member within the metering valve bore.

The metering valve arrangement is particularly suitable for use in an advance arrangement of the type including an advance piston which is moveable within a first bore to adjust the timing of fuel delivery by a high pressure pump and a light load advance arrangement comprising a light load piston moveable relative to the advance piston to adjust the timing of fuel delivery under light load conditions in response to a load-dependent fuel pressure within a light load control chamber, wherein the first outlet of the metering valve arrangement is arranged to communicate with a low pressure drain to control fuel pressure within the light load control chamber and the second outlet port is arranged to communicate with a high pressure pump.

If known advance arrangements of this type, the provision of a droop control arrangement is incompatible with a light load advance arrangement as any adjustment for droop of the metering valve alters the relationship between the pressure of fuel delivered to the pump (filling pressure) and the pressure of fuel within the light load advance arrangement (signal pressure). However, by using the metering valve arrangement of the present invention, any adjustment for droop does not alter the relationship between filling pressure and signal pressure as the first and second outlet ports and the first and second openings are configured to ensure a substantially fixed relationship is always maintained between the first and second fuel flow rates (i.e. a fixed relationship is maintained between filling pressure and signal pressure) for any axial position of the metering valve member within the metering valve bore.

Preferably, the first opening is positioned in relation to the second opening, and the first outlet is positioned in relation to the second outlet, such that for any axial position of the metering valve member within the bore, the first fuel flow rate maintains a substantially constant relationship to the second fuel flow rate.

In a preferred embodiment, the valve housing takes the form of a metering valve sleeve having a tubular side wall within which the first and second outlets are defined.

In a further preferred embodiment, the first outlet has first and second control edges which are substantially perpendicular to one another, and the first opening has first and second control edges which are substantially perpendicular to one another, the first and second control edges of the first outlet and the first and second control edges of the first opening together defining a first area of overlap which determines the rate of flow of fuel through the first outlet, in use.

Similarly, the second outlet has first and second control edges which are substantially perpendicular to one another, and the second opening has first and second control edges which are substantially perpendicular to one another, the first and second control edges of the second outlet and the first and second control edges of the second opening together defining a second area of overlap which determines the rate of flow of fuel through the second outlet, in use.

In a preferred embodiment, the first and second control edges of each of the first opening, the first outlet, the second opening and the second outlet are arranged such that the first area is always substantially equal to the second area, irrespective of the axial position of the metering valve member within the metering valve bore (i.e. for all operating positions of the metering valve member within its bore).

The second control edge of the first outlet and the second control edge of the second outlet are preferably arranged at substantially the same axial position along the metering valve sleeve, the second control edge of the first opening and the second control edge of the second opening are arranged at substantially the same axial position along the metering valve member, the first control edge of the first outlet and the first control edge of the second outlet are circumferentially spaced around an internal diameter of the metering valve sleeve by substantially 180 degrees and the first control edge of the first opening and the first control edge of the second opening are circumferentially spaced around an outer surface of the metering valve member by substantially 180 degrees.

In a still further preferred embodiment, each of the first opening, the second opening, the first outlet and the second outlet has an outer periphery of substantially square or rectangular form.

According to a second aspect of the present invention there is provided an advance arrangement for use in controlling timing of fuel delivery by a fuel pump, the advance arrangement comprising;

an advance piston which is moveable within a first bore to adjust the timing of fuel delivery by the pump, a light load advance arrangement comprising a light load piston moveable relative to the advance piston to adjust the timing of fuel delivery under light load conditions in response to a load-dependent fuel pressure within a light load control chamber, and a metering valve arrangement as herein described, and a droop control arrangement for adjusting the axial position of the metering valve member of the metering valve arrangement within a metering valve bore.

In a preferred embodiment, the advance piston is arranged to cooperate, in use, with a cam arrangement of a fuel pump to adjust the timing of fuel delivery by the pump.

Preferably, the advance arrangement also includes a servo-control piston which is slidable within a further bore provided in the advance piston to control the pressure of fuel within the advance piston control chamber.

In a further preferred embodiment, the metering valve arrangement is operable to vary the rate of flow of fuel through a flow path between the light load control chamber and a low pressure drain, the advance arrangement further comprising an adjustable valve arrangement providing further means for varying a restriction to fuel flow through the flow path. The adjustable valve arrangement preferably includes a valve member which is axially adjustable within an additional bore to vary the restriction to fuel flow through the flow path, the variable restriction preferably being arranged in series with a further fixed restriction.

According to a third aspect of the present invention there is provided an advance arrangement for use in controlling timing of fuel delivery by a fuel pump, the advance arrangement comprising;

an advance piston which is moveable within a first bore to adjust the timing of fuel delivery by the pump, a light load advance arrangement comprising a light load piston moveable relative to the advance piston to adjust the timing of fuel delivery under light load conditions in response to a load-dependent fuel pressure within a light load control chamber, a metering valve arrangement which is operable to vary the rate of flow of fuel through a flow path between the light load control chamber and a low pressure drain, and an adjustable valve arrangement providing further means for varying a restriction to fuel flow through the flow path.

In a preferred embodiment, the adjustable valve arrangement includes a valve member which is axially adjustable within an additional bore to vary the restriction to fuel flow through the flow path, the variable restriction to fuel flow being arranged in series with a further fixed restriction to fuel flow within the flow path.

The provision of the adjustable valve arrangement provides a means of fine tuning the advance characteristic of the arrangement, whereby the degree of advance can be varied to give a required fuelling level at a given engine speed by adjusting the axial position of the adjustable valve member within the additional bore. The adjustable valve arrangement provides a means of compensating for wear of the metering valve arrangement during its service life and/or a means for compensating for manufacturing variations between metering valve arrangements having nominally identical specifications.

It will be appreciated that preferred and/or optional features of the first aspect of the present invention may also be incorporated in the metering valve arrangement of the advance arrangement of the second and third aspects of the present invention.

BRIEF DESCRIPTION OF THE DRAWINGS

The invention will further be described, by way of example only, with reference to the accompanying drawing in which.

DETAILED DESCRIPTION OF THE PREFERRED EMBODIMENT

Figure 1:
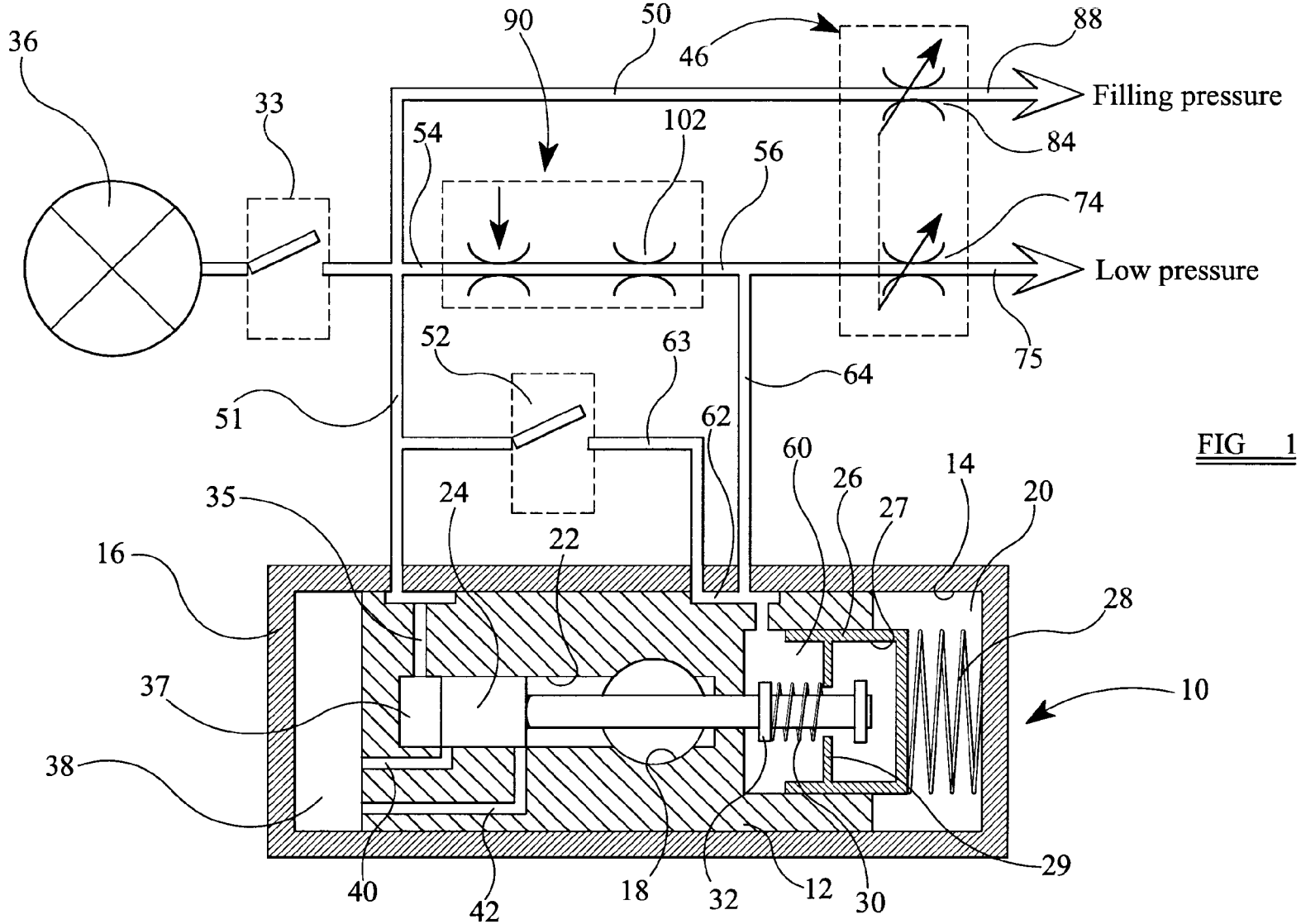
FIG. 1 is a schematic view of an advance arrangement for a fuel pump incorporating a metering valve arrangement in accordance with an embodiment of the present invention.

Referring FIG. 1 shows an advance arrangement, referred to generally as 10, including an advance piston 12 which is slidable within a bore 14 provided in an advance box housing 16. The advance piston 12 is provided with an opening 18 within which a peg (not shown) provided on a cam ring of a high pressure fuel pump (also not shown) is received. Upon axial movement of the advance piston 12 within the bore 14, the peg extending into the opening 18 is caused to move to permit adjustment of the angular position of the cam ring, thereby adjusting the timing of fuel delivery by the high pressure pump.

The advance arrangement of the present invention is suitable for use with a rotary fuel pump of the type described previously. As will be described in further detail hereinafter, the advance arrangement includes a servo-control piston arrangement which is arranged to influence the degree of timing advance depending on the operating speed of the engine, a light load piston arrangement, including a load sensing piston, which is arranged to influence the degree of advance depending on the load under which the engine is operating, and a temperature control valve to influence the degree of advance depending on the operating temperature of the engine.

The advance piston 12 is provided with an axially extending bore 22 within which a servo-control piston 24 is slidable. The bore 22 is shaped to include an enlarged region within which a light load piston 26 is received. The light load piston 26 is provided with a blind bore 27 and carries an annular piece 29 which defines an opening through which the servo-control piston 24 extends. A light load control spring 28 is engaged between one end of the light load piston 26 and an end region of the advance box housing 16, the light load control spring 28 being arranged within a spring chamber 20 and acting on the light load piston 26 to urge the light load piston to the left in the illustration shown in FIG. 1.

A servo control spring 30 is engaged between the annular piece 29 of the light load piston 26 and an annular member 32 carried by the servo-control piston 24. The maximum permitted movement of the servo-control piston 24 relative to the light load piston 26 occurs when an end surface of the servo-control piston 24 is moved into engagement with the blind end of the bore 27 provided in the light load piston 26.

The bore 22 provided in the advance piston 12 and an end surface of the servo-control piston 24 define a servo control chamber 37 which receives fuel through a delivery passage 35 defined within the advance piston. The delivery passage 35 includes an enlarged region at the surface of the advance piston 12 which, through all permitted positions of the advance piston 12 within the bore 14, communicates with a supply passage 50 for fuel.

In use, fuel is delivered to the supply passage 50 from a transfer pump 36 arranged to supply fuel at a pressure dependent upon the speed of the engine (i.e. transfer pressure). The supply of fuel from the transfer pump 36 to the supply passage 50 is controlled by means of an electric shut off valve 33 such that when the engine is shut down no fuel is delivered to the supply passage 50. The supply passage 50 is arranged to supply fuel to the pumping chambers of the associated high pressure fuel pump, the flow of fuel to the high pressure pumping being regulated by means of a metering valve arrangement, as will be described in further detail hereinafter. A supplementary supply passage 51 also receives fuel from the transfer pump, and delivers fuel to the advance arrangement 10.

An advance piston control chamber 38 is defined by an end region of the advance box housing 16 and an end face of the advance piston 12 remote from the spring chamber 20. The advance piston control chamber 38 communicates with fill and drain passages 40, 42 respectively provided in the advance piston 12. In the position shown in FIG. 1, the servo-control piston 24 adopts a position in which its outer surface closes both the fill passage 40, such that communication between the servo control chamber 37 and the advance piston control chamber 38 is broken, and the drain passage 42, such that communication between the opening 18 to cam box pressure and the advance piston control chamber 38 is also broken. In such circumstances the advance piston is in an equilibrium position in which no adjustment to the timing of fuel delivery by the pump is made.

If the pressure of fuel delivered by the transfer pump 36 to the supply passage 50 is relatively low, fuel pressure within the servo control chamber 37 is insufficient to overcome the force due to the servo control spring 30 and the servocontrol piston 24 is not advanced (i.e. the servo-control piston adopts the position shown in FIG. 1). If engine speed increases to increase the pressure of fuel delivered by the transfer pump 36, fuel pressure within the servo control chamber 37 will be increased and a force is applied to the servo-control piston 24 to urge the servo-control piston in a direction of advance (to the right in the illustration shown in FIG. 1), thereby causing communication between the fill passage 40 and the servo control chamber 37 to be opened and permitting fuel to flow into the advance piston control chamber 38. In such circumstances, fuel volume within the advance piston control chamber 38 is increased and the advance piston 12 will be urged to the right in the illustration shown (the advance direction) to advance the timing of fuel delivery.

If fuel pressure within the servo control chamber 37 is reduced upon a reduction in engine speed, the servo-control piston 24 will be urged by means of the servo control spring 30 in a retard timing direction, thereby opening communication between the advance piston control chamber 38 and cam box pressure through the drain passage 42. In such circumstances fuel pressure within the advance piston control chamber 38 is reduced and the advance piston 12 is urged in the retard timing direction (to the left in the illustration shown in FIG. 1). It will therefore be appreciated that the servo-control piston 24 provides a means of controlling the degree of advance of the advance piston 12 in response to speed-dependent fuel pressure variations within the servo control chamber 37.

The light load piston 26 forms part of a light load advance scheme which also includes a light load control chamber 60 defined by the bore 22 in the advance piston 12. The light load control chamber 60 is in communication with a light load supply passage 64 which communicates with the light load control chamber 60 through a drilling 62 provided in the advance piston 12. The advance arrangement 10 is also provided with a cold advance scheme including a temperature control valve 52 which is arranged to supply fuel at transfer pressure through a cold advance supply passage 63 to supplement fuel pressure within the light load control chamber 60 in the event that the temperature of the engine falls below a predetermined amount. Typically, the temperature control valve 52 takes the form of an electromagnetic solenoid valve which is arranged to be closed when the temperature of the engine falls below a predetermined amount. If the engine temperature exceeds the predetermined amount, the temperature control valve 52 is opened and fuel is only supplied to the light load control chamber 60 through the light load supply passage 64. Conveniently, activation of the temperature control valve 52 is controlled by means of a temperature sensor arranged to sense the temperature of the engine water jacket.

Figure 2:
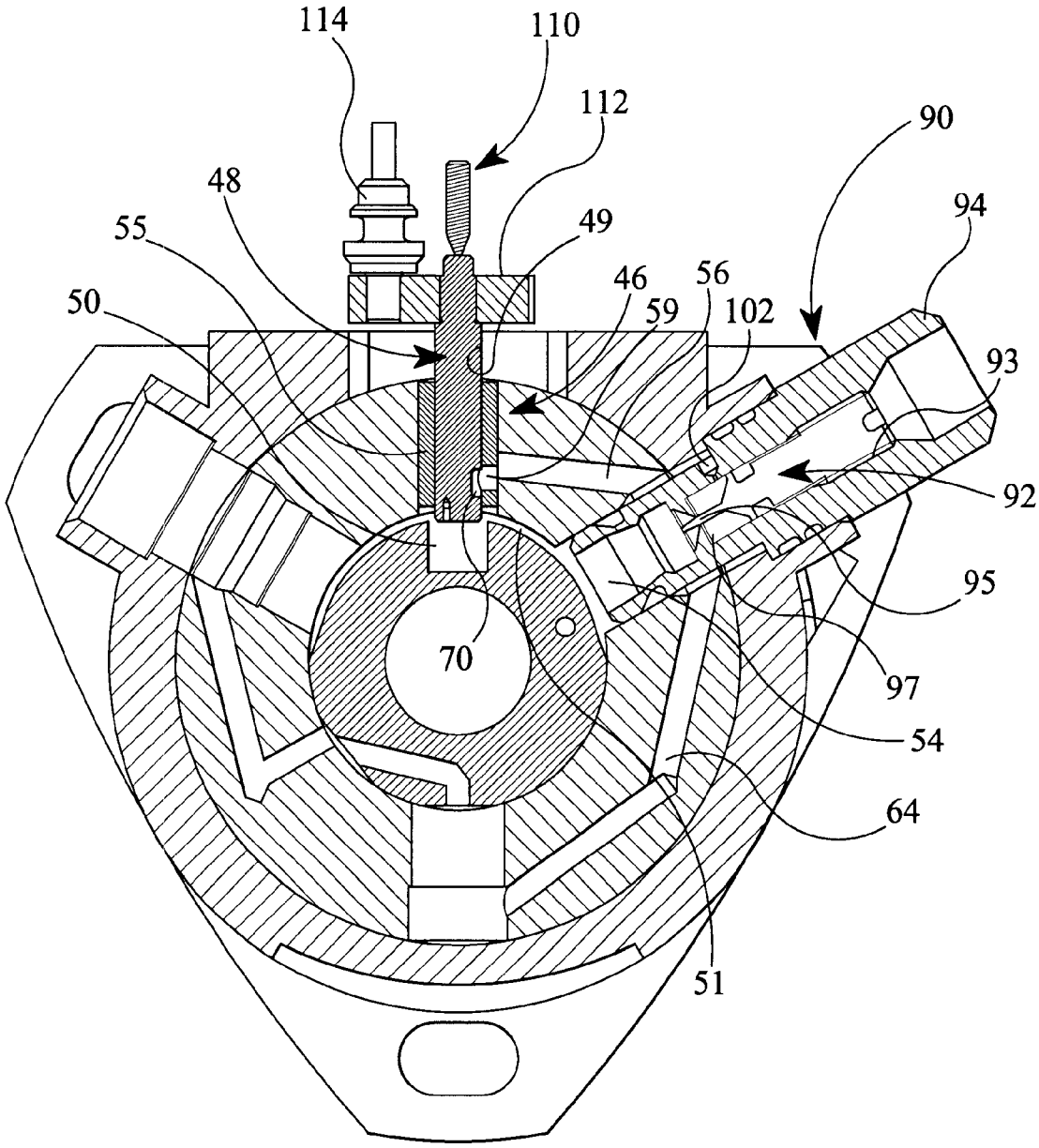
FIG. 2 is a sectional view of a part of the advance arrangement in FIG. 1.

The pressure of fuel delivered to the light load control chamber 60 is determined by the position of a metering valve arrangement 46 in combination with an adjustable valve arrangement, referred to generally as 90. FIG. 2 shows the metering valve arrangement 46 and the adjustable valve arrangement 90 in further detail. The metering valve arrangement 46 includes a metering valve member 48 arranged within a bore 49 provided in a metering valve sleeve 55 having a tubular side wall. The angular position of the metering valve member 48 within the bore 49 is adjustable in response to variations in engine speed so as to vary the rate of flow of fuel between an inlet passage 54 which is supplied with fuel from the transfer pump 36 and a low pressure drain passage (not shown in FIG. 2). An upper end region of the metering valve member 48 is coupled to a crank 112 which is coupled to a spring biased lever (not shown) through a coupling member 114. A centrifugal weight mechanism of a governor acts on the lever in a known manner and causes the lever to pivot to alter the angular position of the metering valve member 48 within the bore 49 in response to variations in engine speed, thereby adjusting the level of fuelling to the high pressure pump to an appropriate amount.

The flow of fuel through the inlet passage 54 passes through the adjustable valve arrangement 90 into an outlet passage 56, from where fuel is delivered to the light load supply passage 64. The outlet passage 56 is also in communication with a signal pressure port 59 provided in the metering valve sleeve 55 which communicates with the low pressure drain passage depending on the angular position of the metering valve member 48 within the bore 49. The rate of flow of fuel from the outlet passage 56 to the drain passage is therefore controlled by adjusting the angular position of the metering valve member 48 within the bore 49.

The adjustable valve arrangement 90 includes a valve member 92 in screw threaded connection with an additional bore 93 provided in a valve housing 94. The valve member 92 includes a projection which extends through an opening defined in the valve housing 94 to control the rate of flow of fuel between an inlet chamber 56 of the adjustable valve arrangement 90 and a further chamber 97 defined by the additional bore 93. The extent to which the projection extends through the opening determines the size of a restriction 95 to fuel flow which can be varied by adjusting the axial position of the valve member 92 within the further bore 93. The variable restriction 95 is arranged in series with a further restriction 102 of fixed size through which fuel within the further chamber 97 flows into the outlet passage 56, the variable restriction 95 and the fixed restriction 102 therefore both being arranged upstream of the metering valve arrangement 46. The metering valve arrangement 46 provides a coarse means of regulating fuel pressure within the light load control chamber (signal pressure) by regulating the rate at which fuel is able to flow from the light load control chamber 60 to low pressure. The adjustable valve arrangement 90 provides a means of fine tuning the advance characteristic of the engine by enabling the degree of light load advance to be varied to give the required level of fuelling at a given engine speed.

The metering valve arrangement 46 is also arranged to regulate the rate of flow of fuel between the supply passage 50 and the high pressure pump, as described in further detail below, but in the section shown in FIG. 2 the ports and openings in the valve components which provide this function are not visible.

The metering valve arrangement 46 is also provided with a droop control arrangement including an adjustment screw 110 which co-operates with the metering valve member 48 to vary the axial position of the metering valve member within the bore 49. The droop control arrangement 110 permits control over the change in engine speed which must occur if the metering valve member 48 is moved between a fully open position, in which a maximum rate of flow of fuel to the high pressure pump is permitted (i.e. maximum filling pressure), and a fully closed position in which there is no flow of fuel to the high pressure pump. The provision of the droop control arrangement is considered to be important as it allows the metering valve arrangement to be adjusted to compensate for wear, and/or for manufacturing variations in governors having nominally identical specifications. In the illustration shown in FIG. 2, the adjustment screw 110 bears directly on the upper end region of the metering valve member 48, but in practice it may be preferable to insert a linkage member between the adjustment screw 110 and the metering valve member 48 whilst still maintaining the required droop control function.

It is important that a constant relationship is maintained between the rate of flow of fuel to the light load supply passage 64 (corresponding to signal pressure) and the rate of flow of fuel to the fuel passage 88 (corresponding to filling pressure), irrespective of the axial position of the metering valve member 48 within the bore 49 in the metering valve sleeve 55. In order to ensure this constant relationship is maintained the metering valve arrangement 46 is configured as shown in FIGS. 3,4 and 5.

Figure 3:
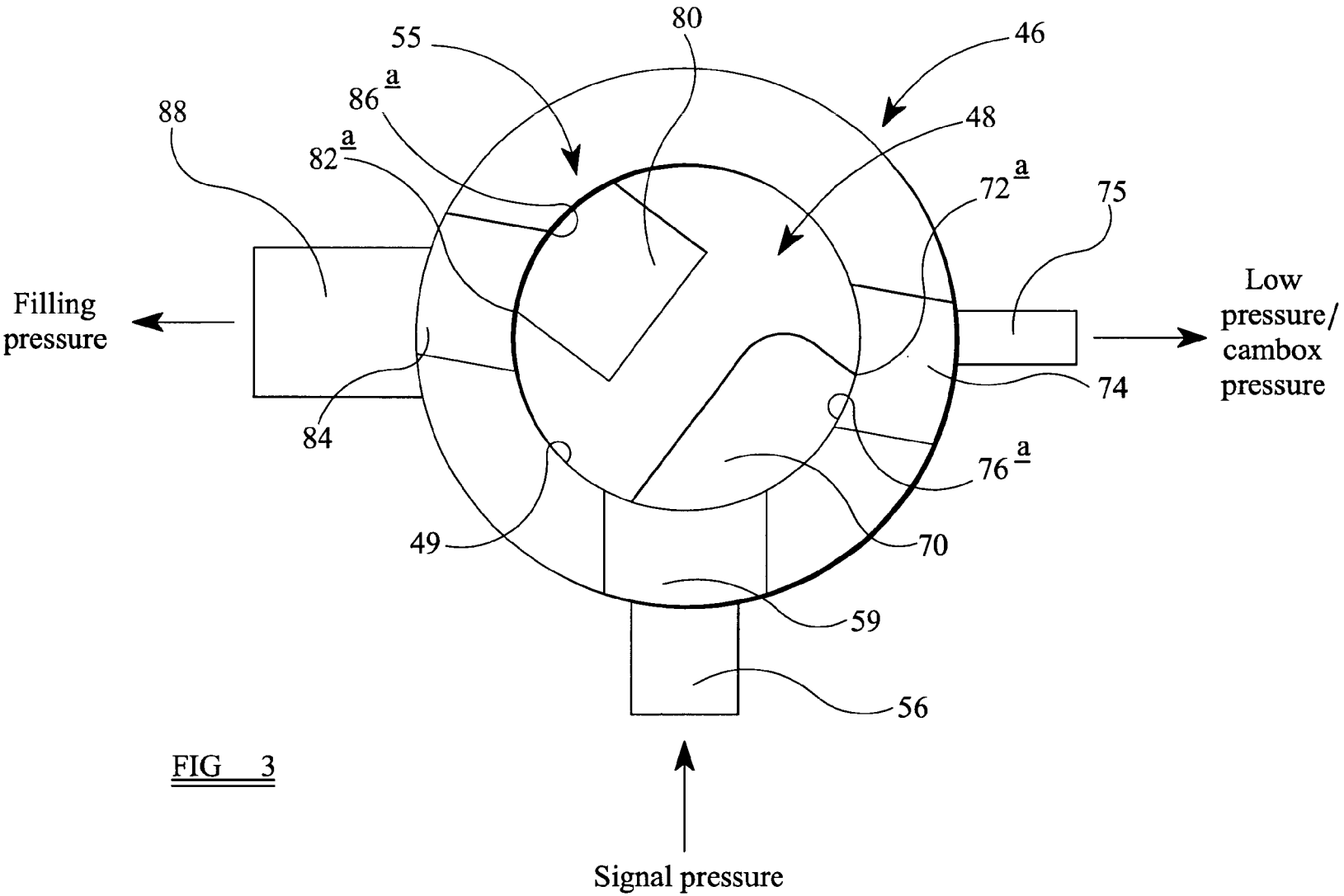
FIG. 3 is a plan view of the metering valve arrangement forming part of the advance arrangement in FIGS. 1 and 2.

The metering valve member 48 is provided with a first recess 70 defining an opening at the surface of the valve member of substantially square or rectangular form and defining first and second control edges 72*a*, 72*b* respectively (only the first control edge is visible in the section shown in FIG. 3). The first recess 70 is registerable with the signal pressure inlet port 59 and an outlet port 74 provided in the metering valve sleeve 55. The angular position of the metering valve member 48 within the bore 49 determines the extent of overlap between the opening defined by the first recess 70 and an outlet port 74 provided in the side wall of the metering valve sleeve 55, the outlet port being in communication with a low pressure drain passage 75. The outlet port 74 provided in the sleeve 55 defines an opening at the inner surface of the bore 49 which also has an outer periphery of substantially square or rectangular form and which defines first and second control edges 76*a*, 76*b* respectively (only the first control edge 76*a* being visible in the section shown in FIG. 3). It will be appreciated that the degree of overlap between the first recess 70 in the metering valve member 48 and the outlet port 74 in the metering valve sleeve 55 determines the rate at which fuel within the outlet passage 56 is able to flow to the low pressure drain passage 75, and therefore determines the pressure of fuel within the light load control chamber 60.

The metering valve member 48 is also provided with a second recess 80 defining an opening at the surface of the metering valve member 48 of substantially square or rectangular form and defining further first and second control edges 82*a*, 82*b* respectively (again, only the first control edge 82*a* is visible in the section shown in FIG. 3). A lower end region of the second recess 80 receives fuel at transfer pressure from the supply passage 50 (as shown in FIG. 1). The opening defined by the second recess 80 is registerable with a filling port 84 defined in the metering valve sleeve 55, the filling port 84 defining an opening at the inner surface of the bore 49 also of substantially square or rectangular form and defining further first and second control edges 86*a*, 86*b* respectively (only the first control edge being visible in the section shown in FIG. 3). Fuel at transfer pressure is delivered to the inlet passage 54, is supplied through a lower end region of the second recess 80 and is able to flow, at a rate dependent upon the extent of overlap between the second recess 80 and the filling port 84, into the fuel passage 88 for delivering fuel to the pumping chambers of the high pressure fuel pump.

Figure 4:
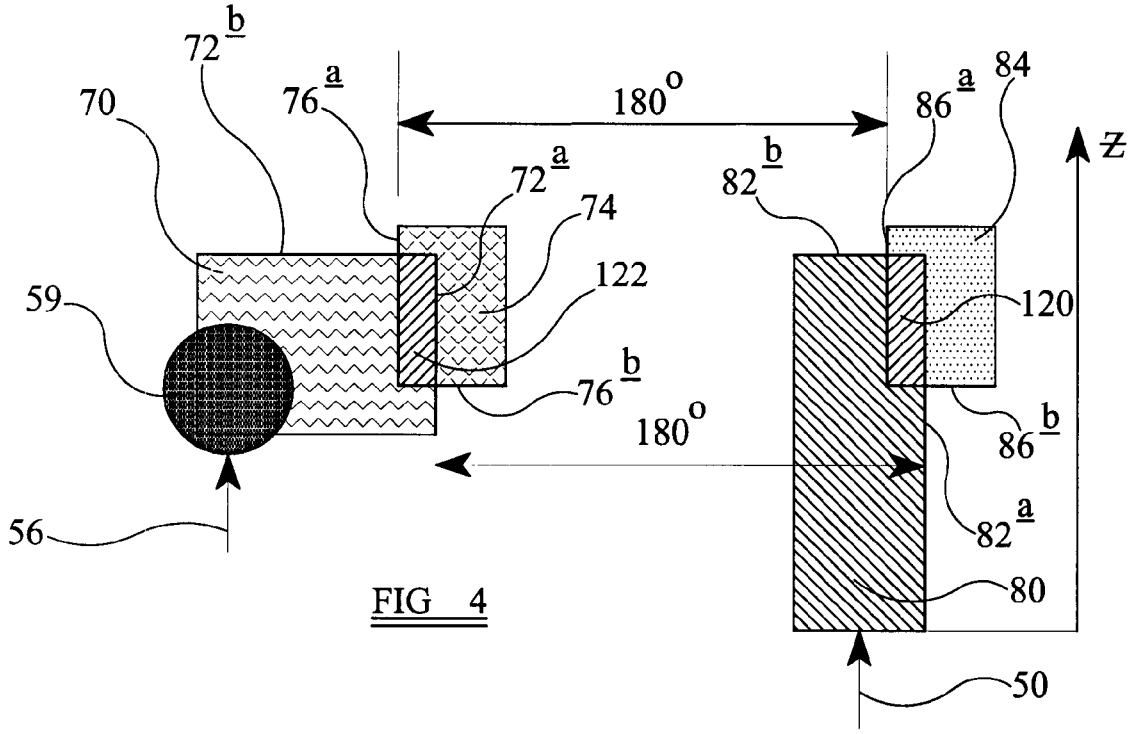
FIG. 4 is a development view of a metering valve member and a metering valve sleeve forming part of the metering valve arrangement in FIG. 3 when the metering valve member is in a first axial position.
Figure 5:
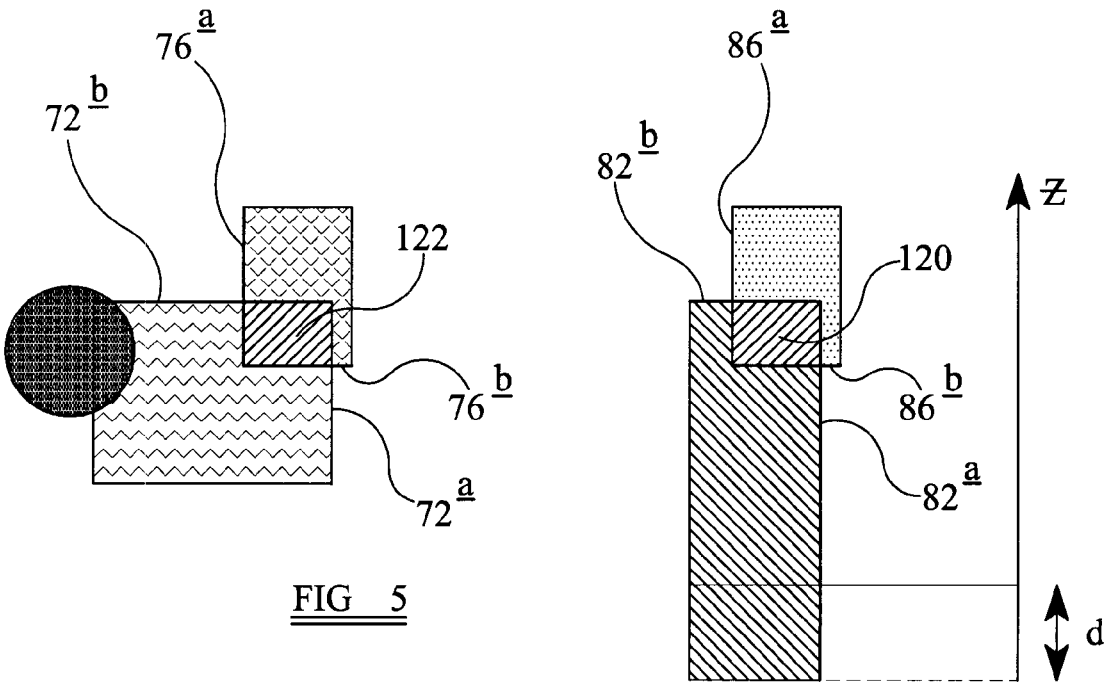
FIG. 5 is a development view of a metering valve member and a metering valve sleeve forming part of the metering valve arrangement in FIG. 3 when the metering valve member is in a second axial position.

As can be seen most clearly in FIG. 4, the control edges 72*a*, 72*b* and 76*a*, 76*b* of the outlet port 74 and of the first recess 70 are positioned in relation to the control edges 82*a*, 82*b* and 86*a*, 86*b* of the second recess 80 and of the filling port 84 respectively such that the first control edge 86*a* of the filling port 84 is circumferentially spaced around the internal diameter of the bore 49 from the first control edge 76*a* of the outlet port 74 by substantially 180°, and such that the second control edge 86*b* of the filling port 84 has an axial position along the metering valve sleeve 55 substantially equal to the axial position of the second control edge 76*b* of the outlet port 74 along the metering valve sleeve 55.

Similarly, the first control edge 82*a* of the second recess 80 is angularly spaced by substantially 180° from the second control edge 72*a* of the first recess 70 around the outer circumference of the metering valve member 48, and the second control edge 82*b* of the second recess 80 has substantially the same axial position along the length of the metering valve member 48 as the second control edge 72*b* of the first recess 70. Also indicated on FIG. 4 are the signal pressure outlet passage 56 to the signal pressure port 59 and the passage 50 to the metering valve arrangement 46, as shown in FIGS. 1 and 2.

In use, the angular position of the metering valve member 48 within the bore 49 of the sleeve 55 will determine a first area 120 of overlap between the filling port 84 and the second recess 80 and a second area 122 of overlap between the outlet port 74 and the first recess 70. The first area 120 of overlap between the filling port 84 and the second recess 80 determines the rate of flow of fuel to the high pressure fuel pump and, for the configuration illustrated in FIG. 4, is substantially the same as the second area 122 of overlap between the outlet port 74 and the first recess 70.

As shown in FIG. 5, if the metering valve member 48 is lowered along the z-axis by a distance, d, the areas 120, 122 of overlap remain substantially equal to one another. The particular configuration of control edges on the first and second recesses 70, 80 and the outlet and filling ports 74, 84 therefore ensures that, even if an adjustment is made to the axial position of the metering valve member 48 by means of the droop control arrangement 110, the relationship between fuel flow rate through the outlet port 74 and fuel flow rate through the filling port 84 remains substantially constant. The present invention therefore provides the advantage that any droop adjustment which is required, for example due to wear or manufacturing variations in the metering valve components, can be compensated for whilst still enabling a light load advance scheme to be incorporated for emissions purposes. The required light load advance characteristics are maintained for any axial position of the metering valve member 48 within the bore 49 by appropriate shaping and positioning of the recesses 70, 80 and the ports 74, 84.

It will be appreciated that it is the positioning of the first and second control edges 86*a*, 86*b* of the filling port 84 in relation to the position of the first and second control edges 76*a*, 76*b* of the outlet port 74 which is important, and likewise the position of the first and second control edges 82*a*, 82*b* of the second recess in relation to the position of the first and second control edges 72*a*, 72*b* of the first recess 70, as it is these control edges which define the areas 120, 122 of overlap. The precise shape, size and relative position of the remaining edges of the filling and outlet ports 84, 74, and of the first and second recesses 70, 80, is unimportant. Although it is only these control edges which align to define the fuel flow areas through the respective ports, and hence only these control edges which must be accurately positioned, for ease of manufacture it may be preferable to shape the ports 74, 84 and recesses 70, 80 such that they define openings of substantially square or rectangular form.

What is claimed is:

1. A metering valve arrangement comprising;

a metering valve member which is angularly adjustable within a metering valve bore provided in a metering valve housing, an adjustment arrangement for adjusting the axial position of the metering valve member within the metering valve bore, a first opening provided in the metering valve member which is registerable with a first outlet provided in the metering valve housing to control a first rate of flow of fluid through the first outlet depending on the angular position of the metering valve member within the bore, and a second opening provided in the metering valve member which is registerable with a second outlet provided in the metering valve housing to control a second rate of flow of fluid through the second outlet, wherein the first and second outlets and the first and second openings are shaped and configured to ensure the first rate of flow of fluid maintains a substantially constant relationship to the second rate of flow of fluid for any axial position of the metering valve member within the metering valve bore.

2. The metering valve arrangement as claimed in claim 1, wherein the valve housing takes the form of a metering valve sleeve having a tubular side wall within which the first and second outlets are defined.

3. The metering valve arrangement as claimed in claim 2, wherein the first outlet has first and second control edges which are substantially perpendicular to one another, and the first opening has first and second control edges which are substantially perpendicular to one another, the first and second control edges of the first outlet and the first and second control edges of the first opening together defining a first area of overlap which determines the rate of flow of fluid through the first outlet, in use.

4. The metering valve arrangement as claimed in claim 2, wherein the second outlet has first and second control edges which are substantially perpendicular to one another, and the second opening has first and second control edges which are substantially perpendicular to one another, the first and second control edges of the second outlet and the first and second control edges of the second opening together defining a second area of overlap which determines the rate of flow of fluid through the second outlet, in use.

5. The metering valve arrangement as claimed in claim 3, wherein the second outlet has first and second control edges which are substantially perpendicular to one another, and the second opening has first and second control edges which are substantially perpendicular to one another, the first and second control edges of the second outlet and the first and second control edges of the second opening together defining a second area of overlap which determines the rate of flow of fluid through the second outlet, in use.

6. The metering valve arrangement as claimed in claim 4, wherein the first and second control edges of each of the first opening, the first outlet, the second opening and the second outlet are arranged such that the first area of overlap is always substantially equal to the second area of overlap, for all operating positions of the metering valve member within the metering valve bore.

7. The metering valve arrangement as claimed in claim 6, wherein the second control edge of the first outlet and the second control edge of the second outlet are preferably arranged at substantially the same axial position along the metering valve sleeve, and wherein the second control edge of the first opening and the second control edge of the second opening are arranged at substantially the same axial position along the metering valve member.

8. The metering valve arrangement as claimed in claim 6, wherein the first control edge of the first outlet and the first control edge of the second outlet are circumferentially spaced around an internal diameter of the metering valve sleeve by substantially 180 degrees, and wherein the first control edge of the first opening and the first control edge of the second opening are circumferentially spaced around an outer surface of the metering valve member by substantially 180 degrees.

9. The metering valve arrangement as claimed in claim 6, wherein each of the first opening, the second opening, the first outlet and the second outlet has an outer periphery of substantially square or rectangular form.

10. The metering valve arrangement as claimed in claim 8, wherein each of the first opening, the second opening, the first outlet and the second outlet has an outer periphery of substantially square or rectangular form.

11. An advance arrangement for use in controlling timing of fuel delivery by a fuel pump, the advance arrangement comprising;

an advance piston which is moveable within a first bore to adjust the timing of fuel delivery by the pump, a light load advance arrangement comprising a light load piston moveable relative to the advance piston to adjust the timing of fuel delivery under light load conditions in response to a load-dependent fuel pressure within a light load control chamber, a metering valve arrangement as claimed in claim 1, wherein the first outlet of the metering valve arrangement communicates with a low pressure drain and a first rate of flow of fuel through the first outlet determines fuel pressure within the light load control chamber, and wherein the second outlet of the metering valve arrangement communicates with the pump and a second rate of flow of fuel determines the pressure of fuel delivered to the pump.

12. The advance arrangement as claimed in claim 11, comprising a servo-control piston which is slidable within a further bore provided in the advance piston to control the pressure of fuel within the advance piston control chamber.

13. The advance arrangement as claimed in claim 11, further comprising an adjustable valve arrangement providing a further means for varying the rate of flow of fuel between the light load control chamber and the low pressure drain through a flow path, wherein the adjustable valve arrangement includes a valve member which is axially adjustable within an additional bore to vary a restriction to fuel flow through the flow path, the variable restriction to fuel flow being arranged in series with a further fixed restriction to fuel flow within the flow path.

14. An advance arrangement for use in controlling timing of fuel delivery by a fuel pump, the advance arrangement comprising;

an advance piston which is moveable within a first bore to adjust the timing of fuel delivery by the pump, a light load advance arrangement comprising a light load piston moveable relative to the advance piston to adjust the timing of fuel delivery under light load conditions in response to a load-dependent fuel pressure within a light load control chamber, a metering valve arrangement which operable to vary the rate of flow of fuel through a flow path between the light load control chamber and a low pressure drain, and an adjustable valve arrangement providing further means for varying a restriction to fuel flow through the flow path.

15. The advance arrangement as claimed in claim 14 wherein the adjustable valve arrangement includes a valve member which is axially adjustable within an additional bore to vary the restriction to fuel flow through the flow path, the variable restriction to fuel flow being arranged in series with a further fixed restriction to fuel flow within the flow path.

* * * * *